US007240724B2

(12) United States Patent
Graham et al.

(10) Patent No.: US 7,240,724 B2
(45) Date of Patent: Jul. 10, 2007

(54) MONOLITHIC TUBE SHEET AND METHOD OF MANUFACTURE

(76) Inventors: Robert G. Graham, 6027 E. Grand Lake Rd., Presque Isle, MI (US) 49777; Dana Goski, 2284 Swansea Rd., Columbus, OH (US) 43221; Anthony S. DiSaia, 80 Woodland Dr., Powell, OH (US) 43065; Ronald G. Brenneman, 11166 Jerome Rd., Plain City, OH (US) 43064; Herman L. Eslick, 5320 Spring Valley Rd., London, OH (US) 43140

( * ) Notice: Subject to any disclaimer, the term of this patent is extended or adjusted under 35 U.S.C. 154(b) by 181 days.

(21) Appl. No.: 10/915,824

(22) Filed: Aug. 11, 2004

(65) Prior Publication Data

US 2005/0035591 A1 Feb. 17, 2005

Related U.S. Application Data

(63) Continuation of application No. 10/638,803, filed on Aug. 11, 2003, now abandoned.

(51) Int. Cl.
*F28F 9/04* (2006.01)

(52) U.S. Cl. ..... 165/158; 165/79; 165/173; 165/178; 264/31; 264/629

(58) Field of Classification Search ..... 165/158, 165/173, 175, 76, 79, 178, DIG. 395, DIG. 397; 264/31, 69, 610, 629
See application file for complete search history.

(56) References Cited

U.S. PATENT DOCUMENTS 641,617 A * 1/1900 Thornycroft ..... 285/89
1,235,057 A * 7/1917 Roberson ..... 165/175
3,610,595 A * 10/1971 Laws et al. ..... 165/76
4,122,894 A * 10/1978 Laws et al. ..... 165/76
5,515,914 A * 5/1996 Lashbrook et al. ..... 165/178
5,630,470 A * 5/1997 Lockwood, Jr. ..... 165/178
5,775,269 A * 7/1998 Lawrence ..... 122/511
5,775,414 A * 7/1998 Graham ..... 165/158
5,865,244 A * 2/1999 Moser ..... 165/173
5,979,543 A 11/1999 Graham
6,174,490 B1 * 1/2001 Brinkman et al. ..... 264/629
6,206,603 B1 3/2001 Graham
2001/0040024 A1 * 11/2001 Blanda et al. ..... 165/134.1
2005/0006056 A1 * 1/2005 Angel et al. ..... 165/158

* cited by examiner

*Primary Examiner*—Teresa J. Walberg
(74) *Attorney, Agent, or Firm*—Robert L. McKellar; McKellar IP Law, PLLC

(57) ABSTRACT

A monolithic refractory ceramic tube sheet for use in all-ceramic air-to-air indirect heat exchangers, the heat exchanger used in all temperature and all pressure applications. A method for forming the monolithic tube sheet includes casting a refractory ceramic in a mold, where portions of the mold comprise the housing of the heat exchanger. Precisely formed negatives are used to form through channels and vacancies within the tube sheet, which are precisely positioned within the mold allowing uniform and flush formation of openings which receive the ceramic tubes therein. The same mold is used to provide both tube sheets of a tube sheet pair allowing accurate alignment of tubes within the exchanger vessel resulting in ease of assembly and equal loading of tubes when in use.

38 Claims, 8 Drawing Sheets

MONOLITHIC TUBE SHEET AND METHOD OF MANUFACTURE

This application is a Continuation of U.S. Utility patent application Ser. No. 10/638,803 filed on Aug. 11, 2003 now abandoned.

BACKGROUND OF THE INVENTION

Heat exchangers are devices built for efficient heat transfer from one fluid to another. Conventional heat exchangers accomplish this heat transfer using a wide variety of interfaces and fluids. This invention is concerned with indirect heat transfer between two fluids of different temperatures across a dividing wall. More specifically, this invention is concerned with an indirect air-to-air heat exchanger, for use in high temperature applications, which uses an array of parallel tubes extending lengthwise within an elongate hollow vessel. The array of tubes is supported at each end of the vessel using a tube sheet. Tube sheets are used to receive the terminal ends of the tubes such that the tubes extend in a direction normal to the tube sheet face. The terminal ends of the tubes are seated within through channels in the tube sheet that allows fluid to pass between the interior of the tube and the opposing side of the tube sheet. The tubes and tube sheets are enclosed by a housing to form the heat exchanger vessel. In the ideal heat exchanger, there is no fluid leakage at the interface of the tube sheet and vessel walls, and there is no fluid leakage at the interface of the tube sheet and tube. The vessel housing typically includes a dome or some other form of enclosure at each end of the vessel which channels fluid to or from the tube sheet. The heat exchanger vessel is also provided with transversely aligned inlet and outlet ports which allow a second fluid to flow within the body of the vessel about the exterior of the tubes.

In such heat exchangers, a first fluid is passed from within a dome at a first end of the heat exchanger, through the tube sheet, through the interior of each tube within the tube array, through a second tube sheet, exiting through a second dome at the second end of the heat exchanger. A second fluid enters the body of the heat exchanger vessel through an inlet port such that it passes transversely through the tube array, passing about the exterior of the tubes, and exiting the vessel via the outlet port. The heat exchangers may be used as described as a single unit, or may be attached in series, dome to dome, with additional vessels to form a heat exchange system.

It is well understood that heat transfer is equally efficient regardless of whether the heating fluid is designated to be the first fluid and the heated fluid to be second fluid, as it is to allow the opposite to be the case. For purposes of discussion of this invention, we will consider the first fluid to be the fluid to be heated, and the second fluid to be the heating fluid.

Conventional heat exchangers, operating in the temperature range of 800 to 1400 degrees F., are constructed using metal tubes and tubes sheets. Typically, the metal tubes are secured to metal tube sheets by welding, or other well-known means. Such heat exchangers fail when operated at higher temperatures, and have a short life span when used with corrosive fluids as found in exhaust gases from industrial operations.

Heat exchangers that must operate in more severe conditions, as found in this invention, are fabricated with ceramic components. Such heat exchangers function well in moderate (1000 degrees F.) to high (2800 degrees F.) temperatures and are resistant to corrosive fluids. Ceramic tubes and tube sheets are well suited to use in severe operating conditions.

However, the material properties of ceramics generate other design considerations. For example, loads need to be distributed evenly across the tube array to prevent any one tube from being overloaded. Thermal expansion of both the tubes and the tube sheets needs to be considered in the design so as to avoid additional stresses at the interface between these components. Finally, fluid leakage between the first and second fluids, such as found at the interface between tube and tube sheet, as well as between the tube sheet and vessel walls must be addressed.

The prior art ceramic tube sheets, such as the tube sheet disclosed in U.S. Pat. No. 5,979,543 to Graham, have been formed of plural individual ceramic tiles, each ceramic tile receiving and supporting multiple ceramic tube-ends. The individual ceramic tiles are then assembled and cemented together to form a generally planar tube sheet. Disadvantages to this type of tube sheet are fluid leakage at the cemented joint between tiles, and difficulty obtaining exact and precise alignment of tiles both within a tube sheet and between tube sheet pairs. Precise alignment between tube sheet pairs is required since it prevents problems with tube assembly, and insures that the tubes are equally loaded during operation.

SUMMARY OF THE INVENTION

The invention is a unitary (one-piece) ceramic tube sheet for use in heat exchangers, and the method of manufacturing the same. More specifically, the invention is a monolithic refractory ceramic tube sheet for use in all-ceramic air-to-air indirect heat exchangers, the heat exchanger used in medium to high temperature applications such as extraction of thermal energy from industrial waste gases for use in a wide variety of applications such as heating clean ambient air.

By forming the ceramic tube sheet as a unitary block or monolith, the fluid leakage between joined ceramic tiles, as in the prior art, is eliminated. Fabrication and assembly of the tube sheet is vastly simplified since multiple small tiles do not have to be assembled and cemented together. Additionally, since the same form may be used to create both tube sheets used within a single heat exchanger, the alignment of ceramic tubes between tube sheet pairs is easily accomplished. This precise alignment of the tubes between the tube sheet pairs is critical since it prevents problems with tube assembly, and insures that the tubes are equally loaded during operation.

The monolithic refractory ceramic tube sheet is described in combination with an adjustable, articulating, sealing plug. The plug is provided in a length such that it extends across the thickness of the tube sheet, and the exterior is provided with threads adjacent the outer (dome side) face of the tube sheet. These threads engage mating threads formed in the tube sheet through channels, allowing the position of the plug to be longitudinally adjusted within the through channel. This ability to adjust the longitudinal position of the plug allows compensation for variations in tube length, and ensures that each tube can be equally loaded at assembly. Additionally, the plug can be completely removed from the outer face of the inventive tube sheet, allowing replacement of a ceramic tube from the dome-side of tube sheet, or outside the heat exchanger itself. Adjacent to the inner (tube side) face of the tube sheet, the plug is provided with an articulated, sealing joint which receives and supports the terminal ends of a ceramic tube. This joint allows rotational motions of the terminal end of the tube, and prevents fluid leakage within the through channel.

A method for forming the monolithic tube sheet is provided. The monolithic tube sheet is formed by casting a refractory ceramic in a mold, where portions of the mold comprise the housing of the heat exchanger. Thus, the tube sheet is cast in place within the housing. This is advantageous since the tube sheet takes on the form of the shell, minimizing fluid leakage between the casting and the shell wall. Additionally, this step further reduces steps in the assembly of the heat exchanger. Precisely formed negatives are used to form through channels and vacancies within the tube sheet, which are carefully and precisely placed within the mold. This precision allows uniform and flush formation of openings which receive the ceramic tubes therein, which is critical so that when assembled and in use each ceramic tube can be equally loaded.

DETAILED DESCRIPTION OF THE INVENTION

Monolithic Tube Sheet

Figure 1:
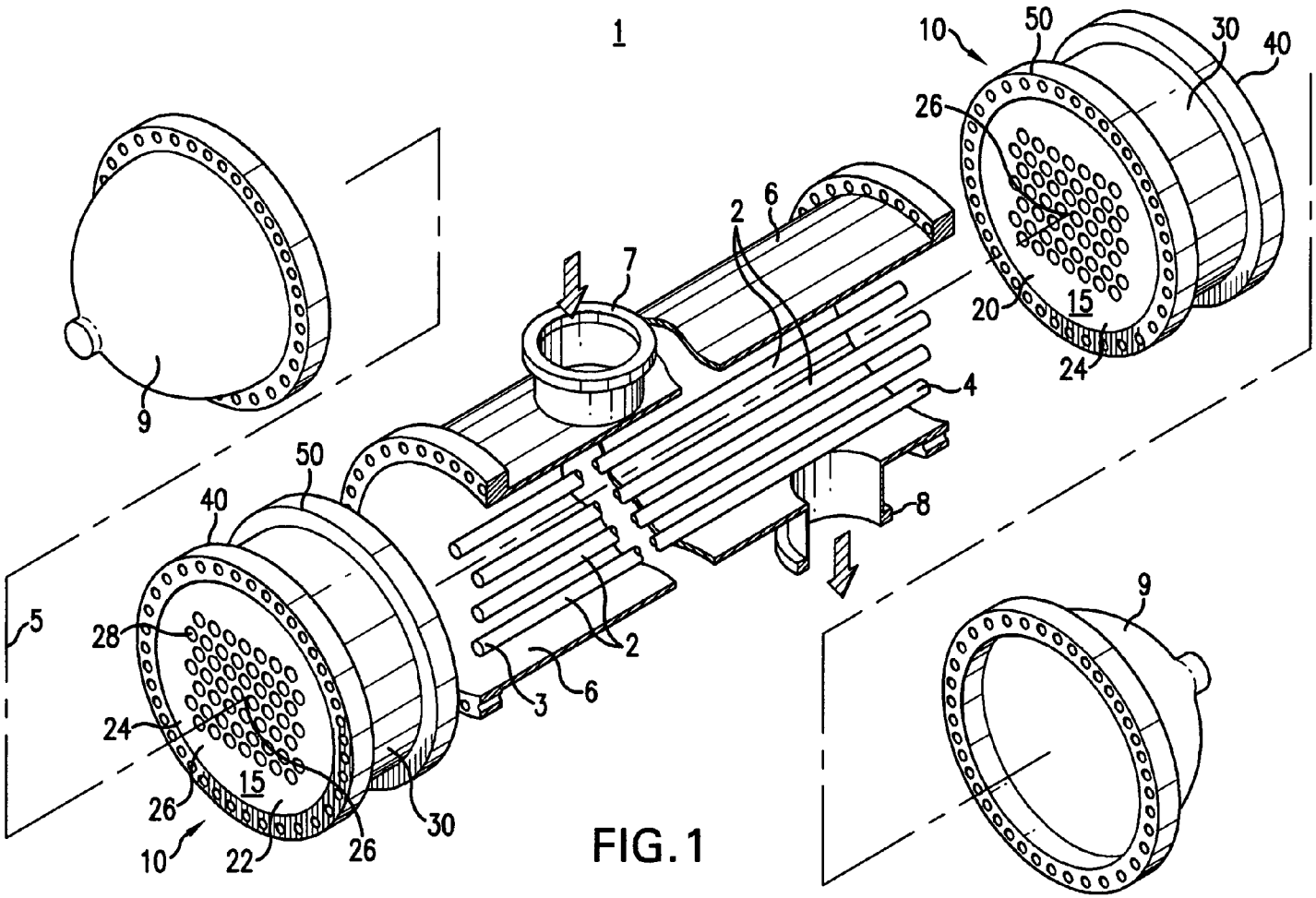
FIG. 1. Exploded perspective view of a partial assembly of a heat exchanger, illustrating the use of a pair of monolithic tube sheets to support the terminal ends of ceramic tubes.
Figure 2:
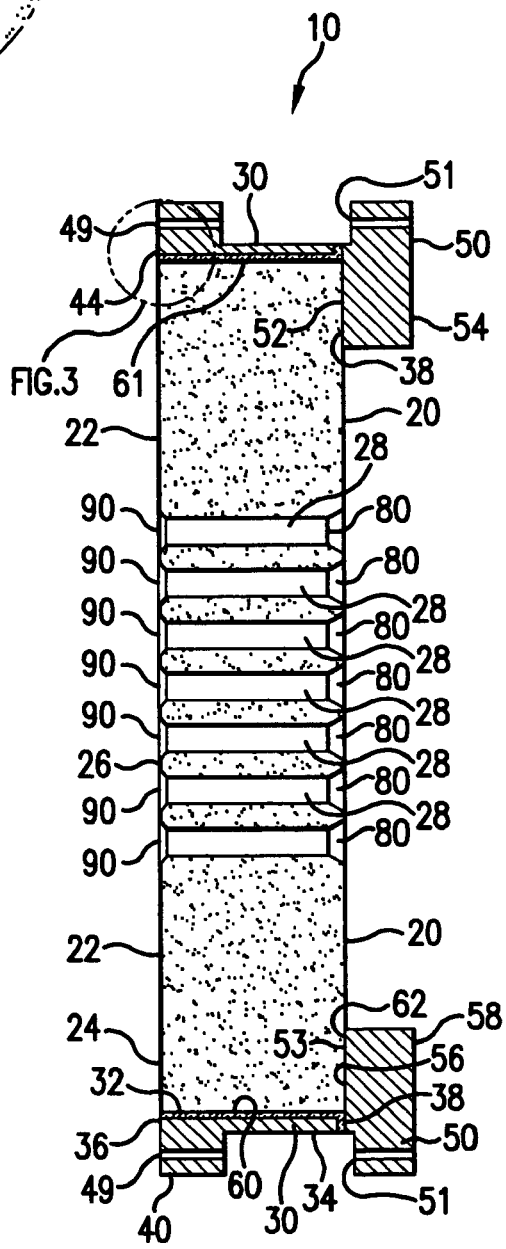
FIG. 2. Side section view of a monolithic tube sheet illustrating the longitudinal orientation of the through channels as well as the relationship of the cast plate to the outer shell.

Referring to FIGS. 1 and 2, the inventive tube sheet 10 will now be described in detail. Tube sheet 10 is a monolithic refractory ceramic plate for use in all-ceramic air-to-air indirect heat exchangers. These ceramic heat exchangers are used in medium to high temperature applications, where metal components are unsuitable. One such application is the extraction of thermal energy from industrial waste gases for use in heating clean ambient air. It is, however, within the scope of this invention to employ the inventive concept in other severe environment applications, which include, but are not limited to, those found in the power and aerospace industries.

The indirect heat exchanger of this invention allows efficient heat transfer from one fluid to another across a tube wall. A first fluid is passed through an array of parallel, elongate tubes such that it flows within the tube interior spaces. The tube array is enclosed within a vessel. A second fluid is passed through the vessel and about the exterior of the tubes such that it flows in a direction perpendicular to the tube array. It is important to note that the heat exchanger will function equally well regardless of whether the heating fluid flows within the tubes or about their exterior. For purposes of describing the instant invention, the first fluid, which travels through the hollow interior of the tubes, is clean ambient compressed air that is to be heated. The second fluid is a hot, contaminated industrial waste exhaust gas, and is used as the heating medium. The second fluid passes in a cross flow across and about the tubes, heating the first fluid.

Within the illustrative heat exchanger 1, a pair of opposed tube sheets 10 are used at either end of the heat exchanger vessel to support the terminal ends 3, 4 of multiple elongate tubes 2 which lie in a parallel configuration in alignment with longitudinal axis 5 of heat exchanger 1. Tubes 2 are supported between tube sheets 10 such that they are under longitudinal compression. This compression loading is used to improve the function of a seal at the junction of tube 2 and tube sheet 10.

For purposes of description of this invention, the number of tubes employed is 52, the tube outer diameter is approximately 2.5 inches, the tube inner diameter is approximately 2 inches, and the tube length is approximately 10 feet. The array of tubes is surrounded by vessel walls 6, which include inflow 7 and outflow 8 ports, aligned perpendicularly to longitudinal axis 5, which provide for cross-flow of the second fluid across and around the tube array. However, it is understood that the number of tubes employed, tube diameter, and tube length are determined by the heat transfer requirements of the specific application, and varies from heat exchanger to heat exchanger. Any dimensions provided herein are to illustrate scale and proportion, and may be altered to meet the design requirements of a specific application.

Tube sheet 10 is a monolithic, or single-piece, refractory ceramic plate 15 enclosed within a shell 30. Plate 15 is provided with an inner face 20 which faces the interior space of the heat exchanger vessel, and an outer face 22, which is opposed to inner face 20 and separated from it by the thickness of plate 15. Inner face 20 and outer face 22 are mutually bounded by peripheral edge 24. Inner face 20 and outer face 22 are parallel planes which lie perpendicular to the longitudinal axis 5 of heat exchanger 1.

Within the illustrative heat exchanger 1 described herein, plate 15 has a circular cross section. It is within the scope of this invention, however, to form tube sheet 10 with other cross sectional shapes which include, but are not limited to, polygons, as required by the design requirements of the specific application. Within heat exchanger 1, tube sheet 10 is subjected to high longitudinal pressures on outer face (dome side) 22, as well as opposing longitudinal pressures on inner face 20 due to the compression loading of tubes 2. The combined weight of the plural ceramic rods is supported by inner face 20.

In the illustrative embodiment, plate 15 is approximately 60 inches in diameter and approximately 12½ inches thick. Thus tube sheet 10 is provided with a diameter to thickness ratio of approximately 5 to 1. This thick plate design compensates for the opposing longitudinal loads on plate 15 due to compressed fluid pressures on outer face 22 and compression pressures on tubes 2 on inner face 20, as well as the transverse load on inner face 20 due to the weight of the ceramic tubes, taking into consideration material properties and safety factors. It is understood that plate diameter and thickness are determined by design requirements of the specific application and will vary from heat exchanger to heat exchanger. Any dimensions provided herein are to illustrate scale and proportion, and may be altered to meet the design requirements of a specific application. However, it should also be understood that in all designs for this application, the ratio of diameter to thickness of plate 15 is relatively large, resulting in plate 15 having a substantive thickness.

Through channels 28 extend through the thickness of plate 15 such that they intersect both inner face 20 and outer face 22, providing fluid communication between the opposing sides of the tube sheet 10. Through channels 28 have a circular cross section and are of generally uniform diameter across the thickness of plate 15, except at the regions adjacent to the respective inner 20 and outer 22 faces. This diameter is approximately that of the inner diameter of tube 2, which in the illustrative embodiment is approximately 2 inches. The number of through channels 28 corresponds exactly to the number of tubes 2. Each terminal end 3, 4 of each respective tube 2 is received within an arcuate seal vacancy 80 formed in through channel 28 at the inner face 20 of tube sheet 10.

Figure 6:
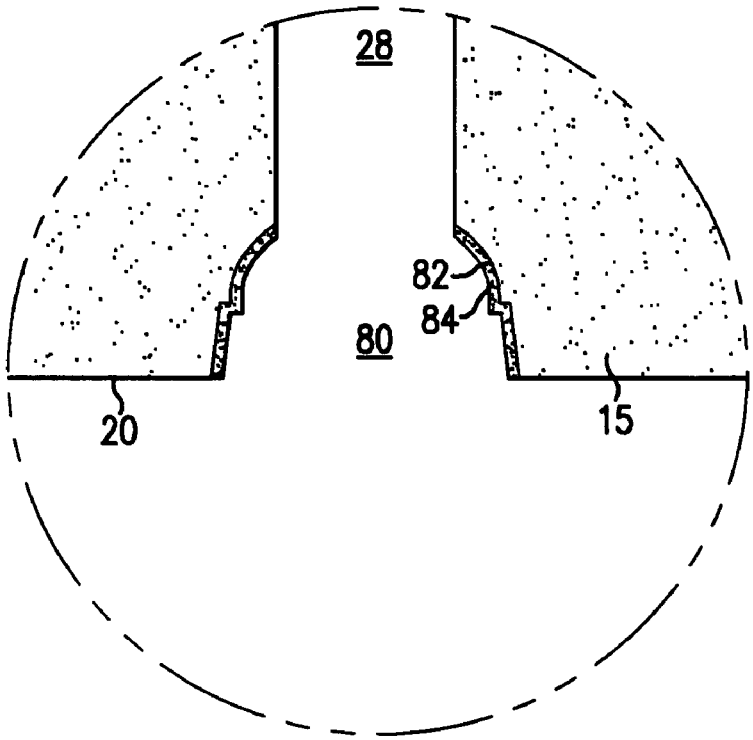
FIG. 6. Side section detail view of a portion of the monolithic tube sheet of FIG. 2, illustrating the vacancy formed at the intersection of the tube through channel and the inner face of the tube sheet for receiving a ball seal therein.

To prevent fluid leakage between terminal ends 3, 4 of tube 2 and tube sheet 10, a seal is used at each respective terminal end 3, 4. Referring to FIG. 6, seal vacancy 80 is formed at the intersection of through channel 28 and inner face 20, and is sized and shaped to receive a seal therein. In the preferred embodiment, seal vacancy 80 is generally spherical in shape so as to receive the preferred seal therein. The preferred seal is an innovative three point ball seal which is described in detail in U. S. Pat. No. 6,206,603. Seal vacancy wall 82 is coated with a smooth, fine grain, high temperature cement 84 to provide a uniform and imperfection-free surface which will optimize the performance of the seal.

Figure 3:
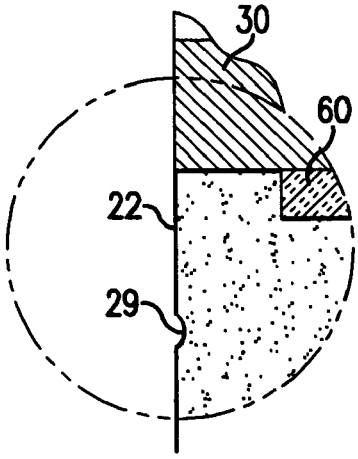
FIG. 3. Side section detail view of a portion of the monolithic tube sheet of FIG. 2, illustrating the O-ring groove formed in the outer face of the tube sheet and the configuration of insulation at outer shell wall.

Outer face 22 is enclosed within dome 9. When tube sheet 10 is located at the fluid inlet side of heat exchanger 1, outer face 22 serves to direct the first fluid into through channels 28 and thus tubes 2. When tube sheet 10 is located at the fluid outlet side of heat exchanger 1, outer face 22 serves to direct the outflow of the first fluid from through channels 28. The heat exchanger unit may be used as a single entity, or may be attached in series (dome 9 to dome 9) with other heat exchanger units. As illustrated in FIG. 3, O-ring channel 29 is a depression formed on outer face 22 adjacent to but spaced apart from peripheral edge 24. O-ring channel 29 is provided with a half-round cross sectional profile. Positioning of O-ring channel 29 on outer face 22 is determined by thermal considerations. In the illustrative embodiment, O-ring channel 29 is spaced approximately 3½ inches from peripheral edge 24, resulting in a circular channel of approximately 53 inches diameter on outer face 22. However, it is understood that channel spacing relative to peripheral edge 24 may be adjusted to accommodate the design considerations of a specific heat exchanger.

When assembled to dome 9, an O-ring is received within O-ring channel 29 as a gasket to prevent fluid and pressure leakage between tube sheet 10 and dome 9. Specifically, the O-ring maintains pressure within the heat exchanger vessel by preventing fluid from bypassing tube sheet 10 and passing through the porous, permeable insulation 60, 62 (discussed below) used between tube sheet 10 and shell 30. The O-ring forces fluid to pass through tube sheet through channels 28 and subsequent tubes 2. In the preferred embodiment, the O-ring is formed of round, seamless copper tubing of ½ inch outer diameter. In use, the O-ring is compressed between tube sheet 10 and dome 9, forming an effective seal. Additional sealing may be obtained by coating outer face 22 with a caulk-like high temperature (1500 degrees F.) sealing compound prior to assembly.

Figure 5:
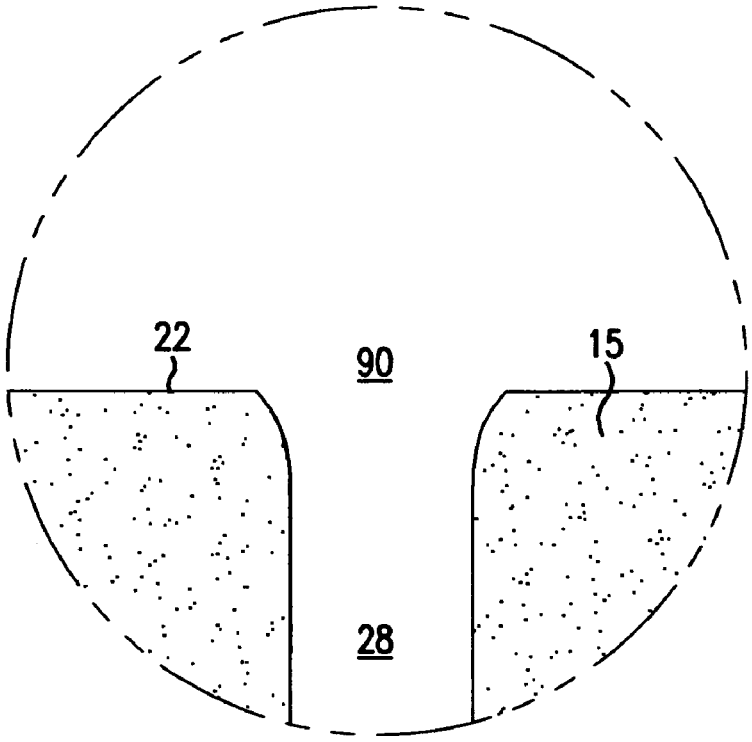
FIG. 5. Side section detail view of a portion of the monolithic tube sheet of FIG. 2, illustrating the widening of the tube through channel at its intersection with the outer face of the tube sheet.

Through channel 28 is provided with a widened portion 90 at its intersection with outer face 22. As shown in FIG. 5, this region of through channel 28 adjacent to the intersection with outer face 22 is provided with a gradually increasing diameter and the intersection between the through channel 28 and the outer face forms a rounded convex shoulder. This widening and rounding of the opening prevents a pressure drop from occurring at the outer face as the first fluid passes to or from tube 2 into dome 9.

Tube sheet 10 is enclosed by a thin-walled hollow cylindrical shell or hoop 30. Shell 30 provides a means to attach tube sheet 10 to the heat exchanger vessel 6, and bears longitudinal load due the high pressures within the heat exchanger vessel. Shell 30 is provided with a shell outer face 34, which corresponds to the exterior surface of the heat exchanger 1 in the region surrounding tube sheet 10. Shell interior face 32 is opposed to shell exterior face 34 and separated from it by the thickness of the shell wall. Shell interior face 32 confronts peripheral edge 24 of tube sheet plate 15. Shell 30 is provided with an shell outer edge 36 and shell inner edge 38. Shell outer edge 36 is opposed to shell inner edge 38, and separated from it by the longitudinal length of the shell.

Outer flange 40 extends outwardly from shell exterior face 34 such that it overlies shell exterior face 34 adjacent to shell outer edge 36, and is aligned flush with shell outer edge 36. Outer flange 40 is provided with 56 flange through holes 49 which extend through its height, equally spaced adjacent to and along the flange exterior face 44. Flange through holes 49 are aligned with corresponding flange through holes on a similar flange provided on dome 9, and receive fasteners therein to secure the outer portion of tube sheet 10 to dome 9.

Inner flange 50 abuts shell inner edge 38 such that it forms a T-shaped cross section where shell 30 is represented by the vertical portion of the T, and inner flange 50 is represented by the cross portion of the T. The cross portion has an interior leg 53 which extends radially inward toward longitudinal axis 5, which is also referred to as the mantle. Exterior leg 51 extends radially outward away from longitudinal axis 5, relative to shell 30. Interior leg 53 of inner flange 50 takes the entire thrust of the high longitudinal pressures on outer face (dome side) 22 of tube sheet 10 within the heat exchanger vessel, and is therefore a relatively substantial member. In the illustrative embodiment, inner flange 50 is approximately 4 inches thick, and interior leg 53 extends inwardly from shell 30 approximately 6 inches.

Inner flange 50 is provided with a flange interior face 52 and flange exterior face 54 that is opposed to flange interior face 52. Inner flange 50 is also provided with a flange first face 56 and a flange second face 58 that is opposed to flange first face 56. Along interior leg 53, flange first face 56 confronts inner face 20 of plate 15 adjacent to peripheral edge 24.

Exterior leg 51 is used to secure the inner portion of tube sheet 10 to a flange on vessel walls 6. Exterior leg 51 is provided with 56 flange through holes 59 which extend through its height, equally spaced adjacent to and along the flange exterior face 54. Flange through holes 59 are aligned with corresponding flange through holes on the vessel wall flange, and receive fasteners therein to secure the inner portion of tube sheet 10 to a flange on vessel walls 6.

In the preferred embodiment, shell 30 is fabricated from steel. It is, however, within the scope of the invention to form shell 30 from other materials that are able to meet design requirements. In the preferred embodiment, outer flange 40 and inner flange 50, also fabricated from steel, are welded to shell 30.

Portions of the interior of shell 30 are lined with thin sheet thermal insulation. Shell interior face insulation 60 overlies shell interior face 32 from shell inner edge 38 to a location spaced apart from shell outer edge 36. This leaves a region adjacent to shell outer edge 36 which is not lined with insulation material. In this region, peripheral edge 24 of plate 15 confronts and abuts shell interior face 32 (see FIG. 3) so as to prevent relative motion of plate 15 within shell 30, and to prevent fluid flow between the ceramic material of plate 15 and the shell due to the porosity of the insulation material.

Flange insulation 62 is positioned on the flange first face 56 at locations that are spaced from shell interior face 32. The unlined portion of flange first face 56 adjacent to shell interior face 32 allows plate 15 to bear the operating pressure load without crushing (thus reducing the effectiveness) of flange insulation 62.

In the preferred embodiment, the material is a microporous thermal insulation formed of bonded silica powders with reinforcing glass filaments such as the material commercially available under the name MICROTHERM. The sheet thermal insulation acts to reduce heat loss through the shell wall, maintain a desired interior temperature, and prevent thermal fatigue of the shell material by maintaining an outer shell temperature of 250 deg F. during use.

Figure 12:
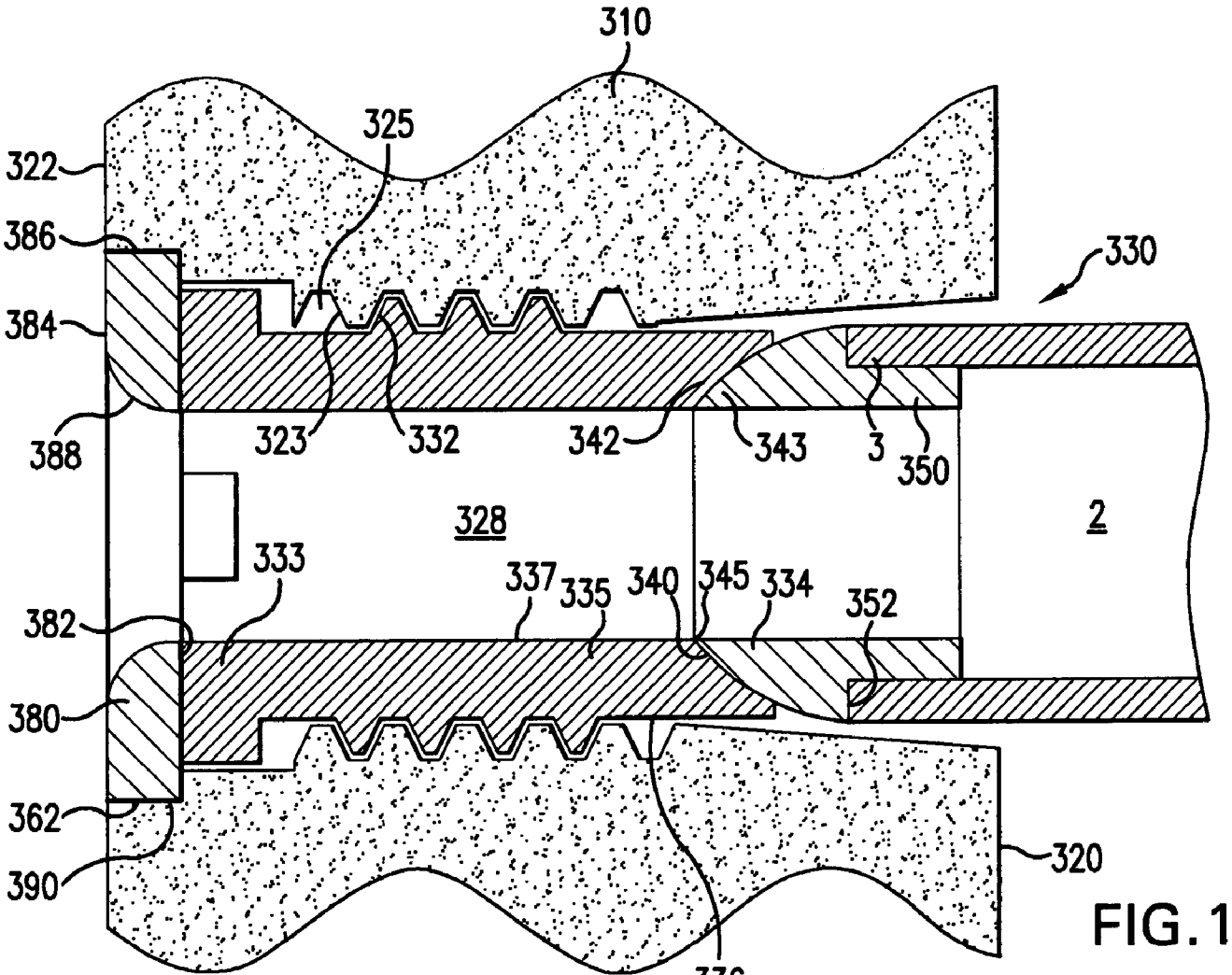
FIG. 12. Side sectional detail view of a tube assembled within a through channel, illustrating a second embodiment of the inventive tube sheet which employs an adjustable, articulating plug within the through channel.

An alternative embodiment of the inventive tube sheet will now be described. Second embodiment tube sheet 310 (FIG. 12) is identical to tube sheet 10 in that it is a monolithic ceramic refractory plate housed within shell 30 as described above. However, each of the plural through channels 328 of second embodiment tube sheet 310 are modified to accommodate a longitudinally adjustable sealing plug 330, one of which resides within each through channel 328 so as to receive and support the terminal ends 3, 4 of ceramic tubes 2.

Plural through channels 328 are located in the central region of tube sheet 310, and extend from inner face 320 to outer face 322 as described above for tube sheet 10. However, the shape of through channels 328 has been modified to accommodate plug 330. The intersection of each through channel 328 and outer face 322 is enlarged to form vacancy 325 having a generally circular cross section of a diameter which is greater than that of the through channel 328. Threads 323 are provided on the surfaces of vacancy 325 for engagement with mating threads 332 on the exterior surface 336 of plug 330. Vacancy 325 is provided with a channel 362 adjacent to outer face 322 sized to receive sealing washer 380 therein. With the exception of vacancy 325, each through channel 328 has a circular cross section and is of generally uniform diameter across the thickness of tube sheet 310, exiting at inner face 320.

Plug 330, a generally elongate hollow tube, is provided with a first end 333, a mid portion 335, and a second end 334, where second end 334 is separated from first end 333 by mid portion 335, and is provided with an exterior surface 336 and an interior surface 337. Plug 330 resides within and along the entire length of each through channel 328 such that first end 333 lies generally adjacent to outer face 322, and second end 334 lies generally flush with inner face 320. Threads 332 are provided on the exterior surface 336 of first end 333. Threads 332 are sized and shaped to matingly engage threads 323 located on the surfaces of vacancy 325 so as to allow securement and longitudinal positional adjustment of plug 330 within each through channel 328.

In the preferred embodiment, plug 330 is formed of silicon carbide. However, it is well within the scope of this invention to form plug 330 from alternative materials, which include, but are not limited to, silicon nitride ($Si_3N_4$), a ceramic body containing a percentage of a thermally conductive material such as 30% alumina oxide ($Al_2O_3$) and 70% silicon carbide (SiC), or metallic ceramics such as metal particle reinforced ceramic tube.

To eliminate fluid leakage between plug 330 and through channel 328, sealing washer 380 is provided at first end 333 of plug 330 at its intersection with outer face 322. Sealing washer 380 resides in a channel 362 such that first face 382 of sealing washer 380 abuts and confronts first end 333 of plug 330. Second face 384 of sealing washer 380 opposes first face 382 and lies flush with outer face 322 of tube sheet 310. Outer (peripheral) edge 386 of sealing washer 380 abuts and confronts channel 362 and is provided in an outer diameter that is slightly larger than that of channel 362. This insures a press fit between sealing washer 380 and channel 362. In the preferred embodiment, sealing washer 380 must be tapped into place using a mallet during assembly. Inner edge 388 of sealing washer 380 is provided an outwardly tapering inner diameter that is continuous with inner surface 337 of plug 330.

Sealing washer 380 is a flat, hollow, annular disk formed of the same material as plug 330. A glaze 390 is applied to outer edge 386 of sealing washer 380 at assembly. Glaze 390 is cured and hardened in the heat and pressure of the initial use of tube sheet 310 and prevents any air leakage between first end 333 of plug 330 and outer face 322 of tube sheet 310. Subsequent maintenance of tube 2 and or plug 330 is achieved by shattering sealing washer 380 by striking it, and then providing a replacement sealing washer 380 after work on tube 2 and plug 330 is completed. The assembly of tube sheet 310, plug 330, and sealing washer 380 thus prevents air leakage at outer face 322 with a gasket-free construction.

Second end 334 of plug 330 is provided with an articulating sealing joint 340 and terminates in an insertion ring 350 that receives the terminal end 3,4 of ceramic tube 2. Articulating sealing joint 340 is spaced apart from insertion ring 350 such that it lies between insertion ring 350 and mid portion 335. Articulating sealing joint 340 consists of a spherical interface 345 formed through second end 334, resulting in two abutting components 342, 343 which are capable of relative rotational motions due to the spherical shape of their mutually confronting surfaces. Spherical interface 345 provides a large area of contact between the two articulating components 342, 343, resulting in an efficient fluid sealing mechanism between the components 342, 343, as well as between articulating sealing joint 340 and tube sheet 310.

A portion of exterior surface 336 is removed at the terminus of second end 334 so as to form an annular shaped, longitudinally aligned extension of interior surface 337, referred to as insertion ring 350. Insertion ring 350 has an outer diameter which is less than that of exterior surface 336 of plug 330, such that ledge 352 is formed at the discontinuity. The outer diameter of insertion ring 350 is slightly less than the interior diameter of tube 2 so that in use, insertion ring 350 is received within the hollow interior of terminal end 3, 4 of tube 2, supporting terminal end 3, 4. Terminal end 3, 4 surrounds insertion ring 350, and abuts ledge 352.

Through channel 238 is provided with a slight tapered widening at the intersection of through channel 328 and inner face 320 of tube sheet 310. This widening prevents interference between terminal end 3, 4 of tube 2 and tube sheet 310 during any deflection of tube 2 during use.

Longitudinal adjustment of plug 330 is achieved by securing plug 330 to tube sheet 310 by engaging threads 332 of plug 330 with threads 323 on the surfaces of vacancy 325 by screwing plug 330 into through channel 328. This ability to adjust the longitudinal position of plug 330 within through channel allows compensation for variations in tube length, ensures that each tube is equally loaded at assembly, and maximizes the sealing characteristics of articulating joint 340. Additionally, plug 330 can be completely removed from outer face 322 of tube sheet 310, allowing replacement of tube 2 from the dome-side of tube sheet 310, or outside the heat exchanger itself.

Method of Manufacture

The method of manufacturing the inventive monolithic refractory ceramic tube sheet 10, intended for use in a heat exchanger operating using temperatures in the range of 1000 to 2800 degrees F., will now be described in detail.

The unitary, single piece refractory plate is fabricated by casting tube sheet 10 in place, as a monolithic structure, within outer shell wall 30 of heat exchanger 1. Plate 15 of tube sheet 10 is formed of a castable refractory ceramic material. The material selected to form plate 15 is required to have thermal expansion characteristics compatible with those of the ceramic tubes, have crushing strength characteristics which meet the pressure requirements of the ends of the heat exchanger vessel, and to be relatively resistant to thermal shock.

Suitable refractory materials for this application include, but are not limited to, those bonded with calcium aluminate cements, those bonded with hydratable alumina, or those bonded with phosphates. Aggregates can range in composition containing various quantities of bauxite, tabular alumina, fused aluminas, fused silica, silicon carbides, natural and synthetic mullite, flint, spinels and magnesias. In the preferred embodiment, the castable refractory ceramic is formed of calcium aluminate bonded with mullite, bauxite, and calcined aluminas.

Figure 7:
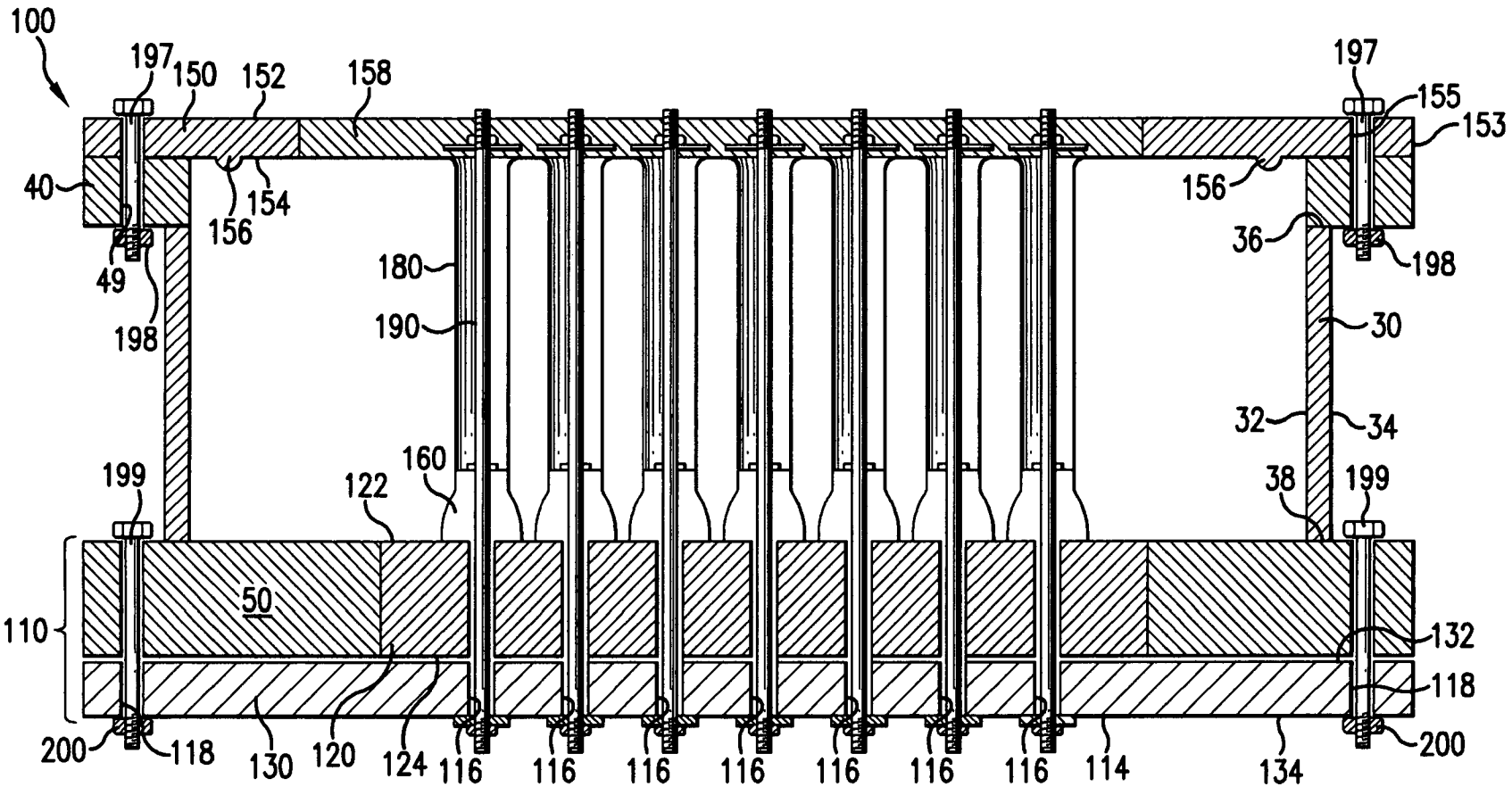
FIG. 7. Side section view of the assembled tube sheet mold.

Method step 1. Provide a mold 100 to receive the cast refractory material (FIG. 7). The components of mold 100 include a bottom plate 110, a top plate 150, cylindrical shell 30, and negatives 160, 180 for forming vacancies within mold 100.

Shell 30, described above, provides the cylindrical outer wall of mold 100. As previously discussed, the cylindrical shape of shell 30 is used for illustrative purposes. It is well within the scope of this invention to provide shell 30 with other cross sectional shapes, which include, but are not limited to, polygons. Bottom plate 110 and top plate 150 are described below as cylindrical in shape, but those skilled in the art will recognize that the shape of these components can be modified to accommodate variation in the shape of shell 30.

Bottom plate 110 comprises a short cylindrical cold rolled steel casting plate 120 which sits concentrically on a short cylindrical alignment plate 130.

Casting plate 120 has a casting plate upper surface 122, and a casting plate lower surface 124, a height of approximately 4½ inches and a diameter of approximately 48 inches. Casting plate upper surface 122 is machined to ensure a precisely flat, true surface.

Alignment plate 130 has an alignment plate upper surface 132, and alignment plate lower surface 134, a height of approximately 1 inch and a diameter of approximately 67 inches. Alignment plate 130 is provided with 56 peripheral through holes 118 which extend through its height, equally spaced adjacent to and along the peripheral edge of alignment plate 130. Peripheral through holes 118 are predrilled with the exact pattern of the holes of inner flange 50, and thus are used as a reference or guide to align bottom plate 110 with shell 30 and to ensure that bottom plate 110 is centered on longitudinal axis 5 of tube sheet 10. When assembled, bolts 199 extend through both peripheral through holes 118 and flange through holes 59 so as to secure bottom plate 110 to shell 30.

Casting plate lower surface 124 is secured to alignment plate upper surface 132 such that the casting plate and alignment plate are concentric. Inner flange 50 of shell 30 is secured to the alignment plate upper surface 132 such that the peripheral edge of casting plate 120 confronts and abuts flange interior face 52 of inner flange 50. The outer diameter of casting plate 120 is sized so as to be received within inner flange 150 with a tight fit so that casting material is not able to seep between these confronting members.

Bottom plate 110 also provided with 52 predrilled negative-locating through-holes 116 through the combined thickness of the casting plate 120 and alignment plate 130, arranged within a generally geometric, preferably rectangular, area. This geometric area is centered on the centerline of bottom plate 110 and spaced apart from its peripheral edge, where the centerline is co-linear with longitudinal axis 5. Through holes 116 are precisely positioned and used to secure negatives 160, 180 in the desired location on casting plate upper surface 122.

Figure 4:
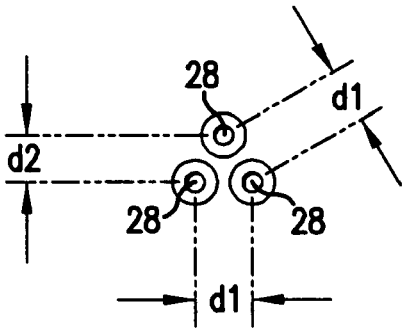
FIG. 4. Side section detail view of a portion of the monolithic tube sheet of FIG. 2, illustrating the tube through channel configuration.

Precise positioning of negative-locating through-holes 116 is critical since an exact match is required for alignment of tubes 2 with an opposing tube sheet mounted at an opposite end of the heat exchanger vessel. To this end, mold components bottom plate 110, top plate 150, and negatives 160, 180 are used twice, to fabricate both tube sheets for use in a single heat exchanger. Negative-locating through holes 116 are arranged in a geometric layout that determines the arrangement of the tube array within vessel 6. As shown in FIGS. 1 and 4, tube through channels 28 are arranged about the centerline 5 of heat exchanger 1 in a rectangular grouping, with the centers of through channels 28 on alternating rows staggered so as to maximize the uniformity of heat transfer across the array.

Figure 8:
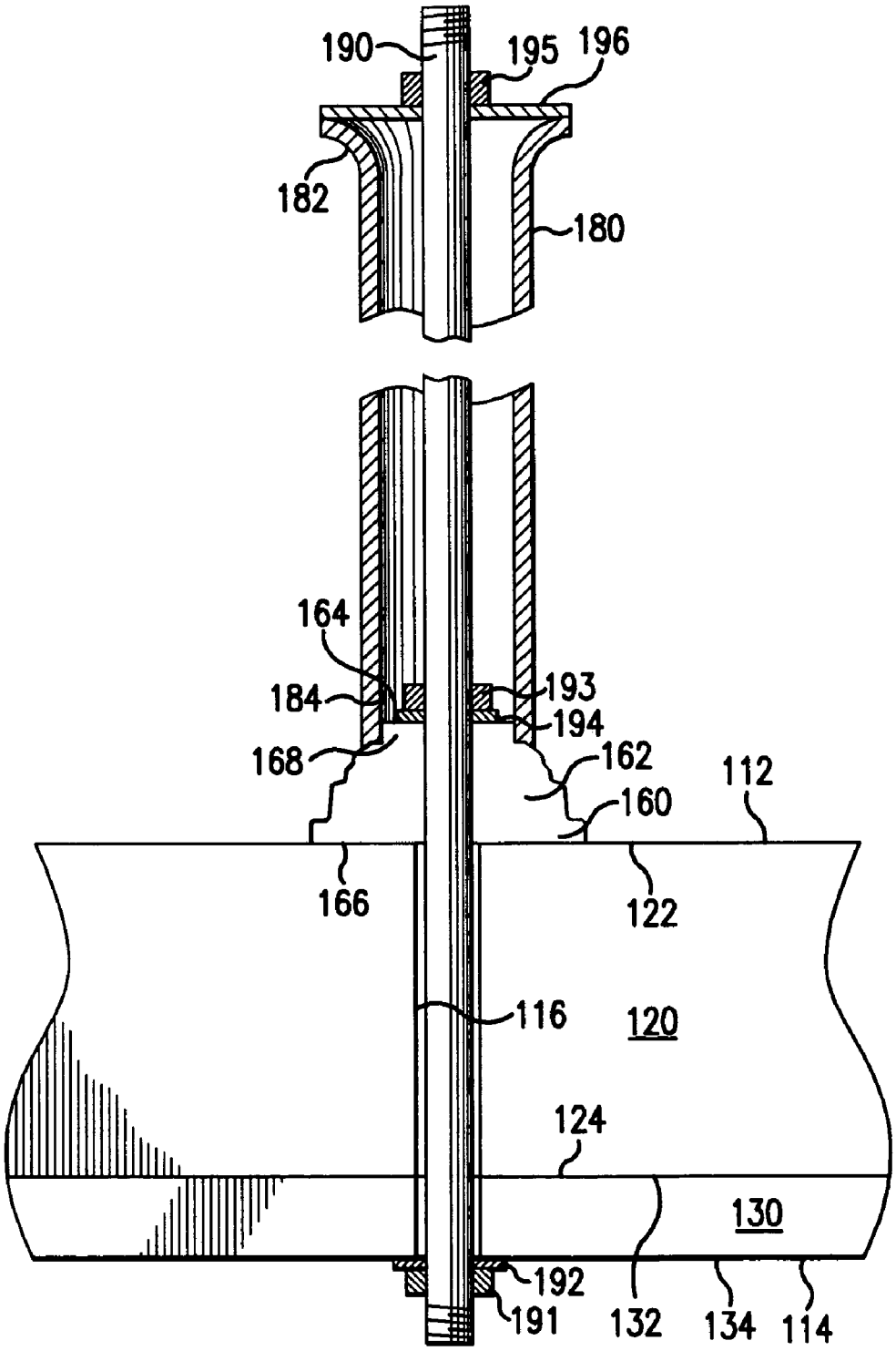
FIG. 8. Side section detail view of a portion of the assembled tube sheet mold of FIG. 7, illustrating the securement of the negatives to the bottom plate of the mold using a precisely positioned through bolt.
Figure 9:
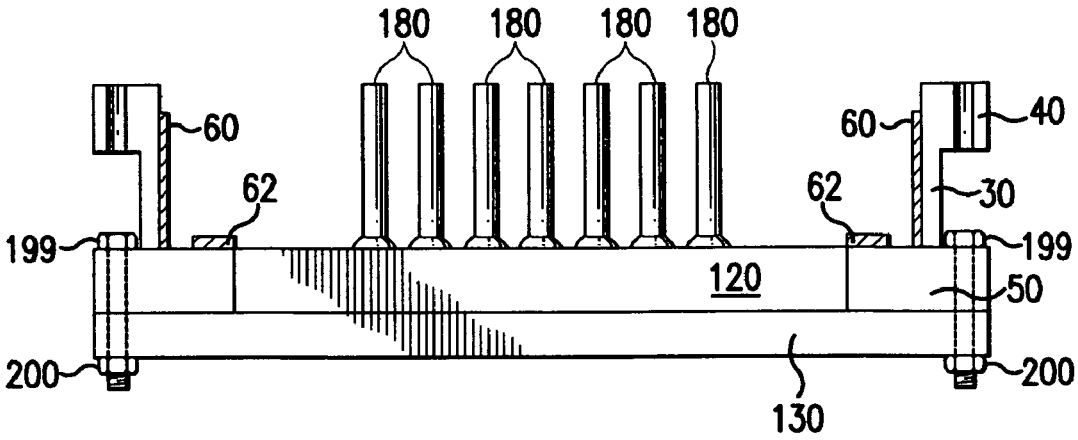
FIG. 9. Side section view of the tube sheet mold, illustrating placement of insulation material along a portion of the outer shell wall and along a portion of the inner flange.
Figure 10:
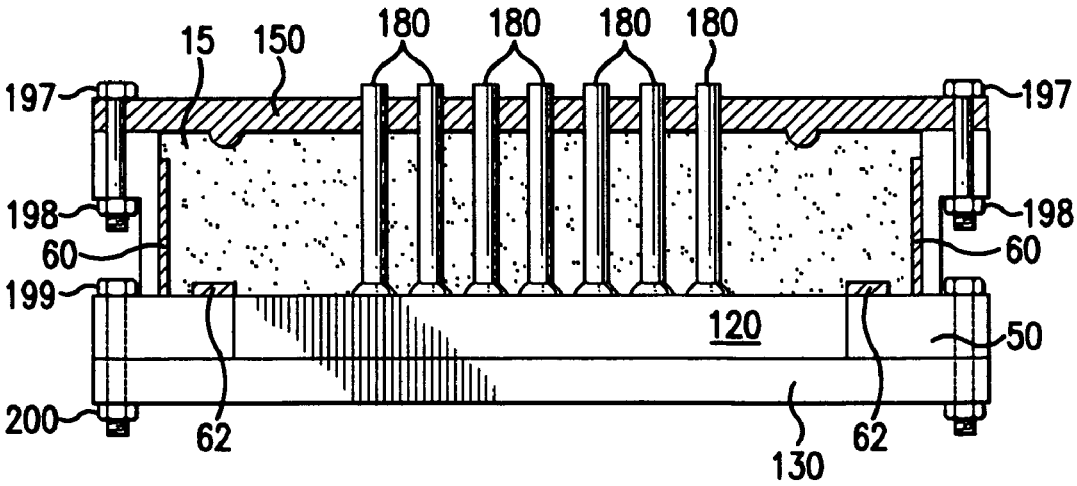
FIG. 10. Side section view of the assembled tube sheet mold with casting material within the mold and the top plate in place.

Referring now to FIG. 8, plural arcuate ball seal negatives 160 are used to create vacancies in the inner face 22 of tube sheet 10. In the preferred embodiment, each ball seal negative 160 is provided with a generally spherical body portion 162, a truncated upper surface 164, and a truncated lower surface 166. Upper surface 164 is provided with an upwardly extending tab, up-set 168. Up-set 168 is received within a lower end of through channel negative 180 as a means to align and anchor through channel negative 180 on the upper surface 164 of ball seal negative 160.

It is understood that the shape of the ball seal negative 160 is not limited to the generally spherical shape described above. The shape of the negative is determined by the shape of the seal employed at the junction between the terminal end of tube 2 and tube sheet 10. In this invention, a generally spherical ball seal is the preferred sealing device, but other sealing mechanisms may be substituted. Thus, providing negatives having alternative exterior shapes, which correspond to alternative sealing mechanisms, are well within the scope of this invention.

Each ball seal negative 160 is located on upper surface of casting plate in alignment with a negative-locating through-hole 116 and secured by a core bolt 190 which through the bottom plate 110. Ball seal negatives 160 must be exactly flush with upper surface of casting plate 120 to prevent seepage of castable material between casting plate 120 and the lower surface 166 of ball seal negative 160.

In the illustrative embodiment, 52 ball seal negatives are formed of nylon and machined to exact tolerances. In the preferred embodiment, the material used to form ball seal negatives 160 is ultra high molecular weight polyethylene. This material is selected because of its ability to maintain the desired shape under the weight of the refractory material when being cast, while being flexible enough such that the refractory material will not crack during the curing stage. It is well within the scope of this invention, however, to fabricate ball seal negatives 160 from machined materials or materials cast from urethane, plastic, or rubber.

Plural through channel negatives 180 are used to create fluid through channels within the unitary, single piece refractory plate 15. Through channel negatives 180 are fabricated of an elongate section of plastic pipe. The pipe is provided with an enlarged upper end 182 which is sized and shaped to provide the shaped widening 90 at the outer face 22 of tube sheet 10, and a mid portion 186 and lower end 184 of uniform outer diameter sized to meet the requirements if the inner diameter of the tube sheet through channels 28. Hollow lower end 184 slides over up set 168 so as to secure and align through channel negative 180 to the upper end 168 of ball seal negatives 160.

Core bolt 190 is long enough to extend completely through bottom plate 110, ball seal negative 160, and through channel negative 180. Core bolt 190 is secured to the alignment plate lower surface 134 using a first nut 191 and washer 192, to the upper surface 164 of ball seal negative 160 using a second nut 193 and washer 194, and to the upper end 182 of through channel negative 180 using a third nut 195 and washer 196.

The number of through channel negatives 180 corresponds exactly to the number of through channels required within tube sheet 10. In the illustrative embodiment, 52 through channel negatives are provided. In the preferred embodiment, the polyvinyl chlorate (PVC) is used to form through channel negatives 180. As in the case of ball seal negatives 160, the material is selected because of its ability to maintain the desired shape under the weight of the refractory material when being cast, while being flexible enough such that the refractory material will not crack during the curing stage. It is well within the scope of this invention to fabricate through channel negatives 180 from machined materials or materials cast from urethane, plastic, or rubber.

Figure 11:
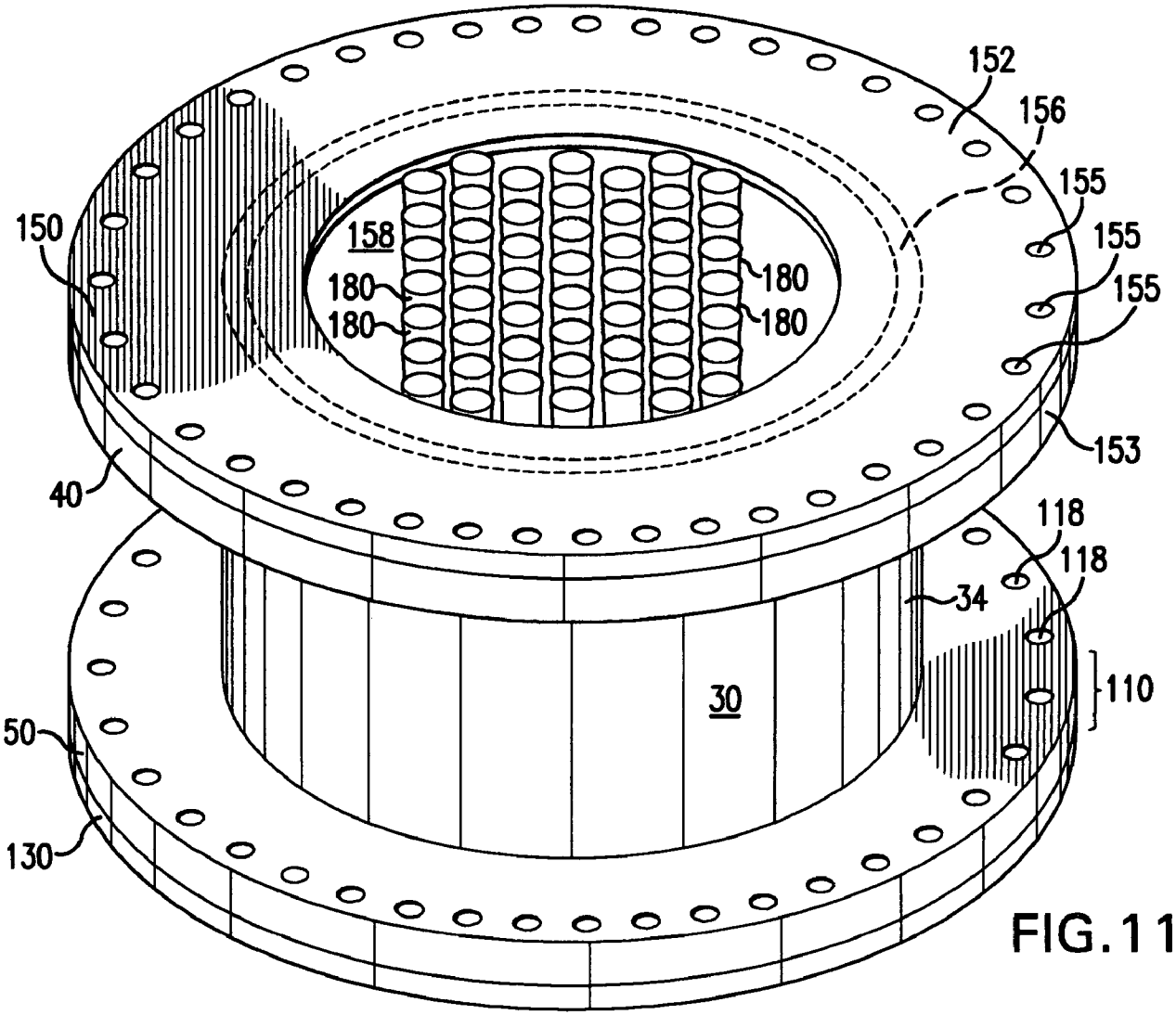
FIG. 11. Top perspective view of the assembled tube sheet mold illustrating the central opening in the top plate which allows the negatives to extend beyond the top plate, and also provides a means by which casting material is added to the mold.

Top plate 150 comprises a cylinder having a top plate upper surface 152 and a top plate lower surface 154. Top plate 150 is a short cylinder, having an approximate height of 1" and approximate diameter of 67 inches in the illustrative embodiment. The purpose of top plate 150 is to create a flush refractory casting surface that corresponds to tube sheet outer face 22. Central opening 158, a large opening in the central portion of top plate 150, surrounds upper ends 182 of through channel negatives 180, and provides an opening in mold 100 through which refractory ceramic material is cast. Central opening 158 may be provided in a generally circular shape (FIG. 11), or may be provided in any convenient alternative shape including, but not limited to, polygonal.

Lower surface 154 of top plate 150 is provided with an outwardly extending half-round bead 156. Bead 156 extends about the periphery of top plate 150 such that it is spaced apart from both its peripheral edge and central opening 158. In use, bead 156 extends into the cast material and forms O-ring channel 29 in tube sheet outer face 22.

Top plate 150 is provided with 56 peripheral through holes 155 which extend through its height, equally spaced adjacent to and along the peripheral edge of top plate 150. Peripheral through holes 155 are predrilled with the exact pattern of the holes of outer flange 40, and are used to secure top plate 150 to shell 30 during the casting procedure. When assembled, bolts 197 extend through both peripheral through holes 155 and outer flange through holes 49 so as to top bottom plate 150 to shell outer edge 36.

Method step 2. Coat negatives 160, 180 with release agents.

Method step 3. Line portions of the mold with sheet insulation material so as to reduce heat loss through the shell wall, maintain a desired interior temperature, and prevent thermal fatigue of the shell material by maintaining an outer shell temperature of 250 deg F. during use. Insulation (shell insulation 60) is placed overlying shell interior face 32 from shell inner edge 38 to a location spaced apart from shell outer edge 36. Insulation (flange insulation 62) is also positioned on flange first face 56 of inner flange 50 at locations that are spaced from shell interior face 32.

Method step 4. Prepare refractory ceramic material as a wet mix.

Method step 5. Cast the monolithic refractory ceramic plate 15 by placement of mold 100 on top of a vibrating table, and pouring the wet mix into mold 100 through top plate central opening 158, between top plate 150 and plural through channel negatives 180.

Method step 6. After the refractory is cast into the mold, vibrate the mold (electrically or pneumatically) to remove air pockets from the material and provide a dense, uniform mass. The preferred refractory ceramic material requires 2800–3000 vibrations per minute for approximately 20 minutes.

Method step 7. The entire mold 100 with cast refractory material is leveled to ensure a finished product having inner 20 and outer 22 faces that are normal to the cylindrical walls of shell 30.

Method step 8. The entire leveled form with cast refractory material is covered with a bilayer covering which consists of an inner layer of wet burlap and an outer layer of plastic. This bilayer covering prevents quick dehydration and formation of a "skin", and allows slow maturation of the casting. A curing compound may also be used to provide a uniform cure and prevent pocketing of water.

Method step 9. Allow to air dry for 24–48 hours, depending on the thickness of plate 15.

Method step 10. Remove top plate 150 from monolithic plate 15. Additional drying time may be required.

Method step 11. Remove bottom plate 110 and plural ball seal negatives 160, leaving shell 30 in place about plate 15 and leaving the plural through channel negatives 180 in place within plate 15.

Method step 12. Coat seal vacancy wall 82 with a smooth, fine grain, high temperature air-setting cement 84 to provide a uniform and imperfection-free surface which will optimize the performance of the seal.

Method step 13. Place casting on a rack in a curing furnace and cure at temperatures to remove free and chemical water, and to burn out through channel negatives. Curing is completed in a 72 hour ramp cycle.

The method steps described above provide the inventive unitary, single piece refractory tube sheet 10, which is cast in place, as a monolithic structure, within the cylindrical walls of shell 30 for use in heat exchanger 1.

While we have shown and described the preferred embodiment of our invention, it will be understood that the invention may be embodied otherwise than as herein specifically illustrated and described, and that certain changes in the form and arrangements of parts and the specific manner of practicing the invention may be made within the underlying idea or principles of the invention within the scope of the appended claims.

What is claimed is:

1. A monolithic refractory ceramic plate for supporting the terminal ends of elongate ceramic tubes, said plate comprising an inner face, and an outer face opposed to said inner face and separated from the inner face by the thickness of the plate, said plate further comprising a longitudinal axis which lies normal to both said inner face and said outer face, each of said inner face and said outer face comprising a peripheral edge, said plate comprising an outer wall which corresponds to the thickness of the plate and extends between said inner face and said outer face, said plate comprising a central region which is surrounded by and spaced apart from said outer wall, said central region being centered on said longitudinal axis, said plate comprising a plurality of through channels sized to receive the terminal ends of elongate tubes, said plurality of through channels being located in said central region and aligned in parallel with said longitudinal axis.

2. The monolithic refractory plate of claim 1 wherein each of said plurality of through channels comprise an inner end which intersects said inner face of said plate, and each of said plurality of through channels comprise an outer end which intersects said outer face of said plate, wherein said inner end of each of said plurality of through channels is provided with a widened portion adjacent said inner face, said widened portion comprising an arcuate vacancy which is sized and shaped to receive an arcuate sealing member therein.

3. The monolithic refractory plate of claim 2 wherein said widened portion is provided with a coating to provide a uniformly smooth surface.

4. The monolithic refractory plate of claim 2 wherein said outer end of each of said plurality of through channels is provided with a widened portion adjacent said outer face such that the intersection between each of said plurality of through channels and said outer face forms a rounded convex shoulder.

5. The monolithic refractory plate of claim 4 wherein said plate is fabricated in the shape of a cylinder, and said cylinder has a thickness and a diameter, said plate being fabricated to have a diameter to thickness ratio of approximately 5 to 1.

6. The monolithic refractory plate of claim 1 wherein said plate further comprises a shell, said shell comprising a hoop formed in the shape of a hollow cylinder, said hoop having a thickness and a height, said hoop comprising a hoop inner face and a hoop outer face, the hoop inner face being opposed to and separated from the hoop outer face by the thickness of the hoop, where the thickness of the hoop is small relative to the height of the hoop, said hoop comprising a first hoop edge and a second hoop edge, the first hoop edge being opposed to the second hoop edge and separated from it by the respective hoop inner and outer faces, and said hoop inner face confronts and abuts at least a portion of said outer wall of said plate.

7. The monolithic refractory plate of claim 6 wherein said hoop comprises a first flange and a second flange, wherein said first flange lies adjacent to said first hoop edge, and wherein said second flange lies adjacent to said second hoop edge.

8. The monolithic refractory plate of claim 7 wherein insulation means is provided between portions of said outer wall of said plate and said hoop inner face, and wherein insulation means is provided between portions of said second flange of said hoop and inner face of said plate.

9. A unitary ceramic tube sheet for supporting the terminal ends of plural elongate ceramic tubes within a heat exchanger operating using temperatures in the range of 1000 to 2800 degrees F., the tube sheet comprising a single, unitary plate, the plate comprising a central region and a peripheral region, said central region surrounded by and concentric with said peripheral region, the central region comprising a plurality of through holes sized and shaped to receive the terminal ends of said plural elongate ceramic tubes therein, the peripheral region comprising securement means for securing said tube sheet within a heat exchanger.

10. The unitary ceramic tube sheet of claim 9 wherein the peripheral region further comprises insulation means for maintaining a minimum required temperature in said peripheral region during use.

11. The unitary ceramic tube sheet of claim 9 wherein the plate comprises an inner face and an outer face, said inner face being opposed to said outer face and separated from it by the thickness of said plate, the plate comprising a longitudinal axis which lies perpendicular to both said inner face and said outer face, wherein said plurality of through holes extend through the thickness of said plate such that they lie in parallel with the longitudinal axis, each of said plurality of through holes comprising a circular cross section of a first diameter, each of said plurality of through holes having an enlarged region adjacent to said inner face such that the intersection of each of said plurality of through holes with said inner face comprises a circular cross section of a second diameter, wherein the second diameter is greater than the first diameter.

12. The unitary ceramic tube sheet of claim 11 wherein each of said plurality of through holes having an enlarged region adjacent to said outer face such that the intersection of each or said plurality of through holes with said outer face comprises a tapering cross section, said tapering cross section having a minimum diameter at a location spaced from said outer face, and a maximum diameter at said intersection with said outer face.

13. The unitary ceramic tube sheet of claim 12 wherein said plate is fabricated in the shape of a cylinder, and said cylinder has a thickness and a plate diameter, said plate being fabricated to have a plate diameter to thickness ratio of approximately 5 to 1.

14. A method of casting a unitary, single piece refractory plate for supporting the terminal ends of elongate ceramic tubes within a heat exchanger operating using temperatures in the range of 1000 to 2800 degrees F., the unitary, single piece refractory plate being fabricated using the following method steps:

Step 1. Provide a mold where the mold includes a steel bottom plate, top plate, cylindrical shell, plural ball seal negatives, and plural through channel negatives, wherein said bottom plate comprises a short cylindrical casting plate which sits concentrically on a short cylindrical alignment plate of larger diameter than the casting plate, said plural ball seal negatives are used for forming vacancies to receive spherical ball seals therewithin, said plural ball seal negatives being machined to exact tolerances, coated with release agents, and mounted to an upper surface of the casting plate, said plural through channel negatives are used for forming generally cylindrical through channels within the unitary, single piece refractory plate, said plural through channel negatives being machined to exact tolerances, coated with release agents, and then secured to an upper end of a respective said plural ball seal negative, said cylindrical shell comprises a hollow cylinder, said cylinder comprising an outer diameter, an first edge, an second edge, said first edge being opposed to and separated from said second edge by the height of the cylinder, the cylinder comprising an inner surface and an outer surface, said inner surface being opposed to and separated from the outer surface by the thickness of the cylinder, the cylinder comprising a first flange which extends from said first edge of said cylinder and a second flange which extends from said second edge of said cylinder, said top plate comprises a short cylinder having a top plate diameter, a top plate upper surface, and a top plate lower surface, wherein said top plate diameter is equal to the shell outer wall diameter, such that in use, the alignment plate is secured to the first flange of the cylindrical shell such that the casting plate is concentric with and surrounded by the first flange, such that the periphery of the alignment plate abuts a lower face of the first flange, such that an upper face of the casting plate and an upper face of the first flange provide a bottom surface for the mold, and such that the cylindrical shell provides outer walls for the mold, the plural ball seal negatives are secured to the bottom surface of the mold using precisely located predrilled through holes within the bottom plate, the top plate is secured to the second flange of the cylindrical shell, the top plate comprising a centrally aligned opening which surrounds the plural through channel negatives such that the plural through channel negatives extend upward through said centrally aligned opening therein, Step 2. Line portions of the mold with sheet insulation material so as to maintain an outer shell temperature of 250 deg F. during use, Step 3. Cast the unitary, single piece refractory plate by placement of said mold on top of a vibrating table, preparation of refractory material as a wet mix, and pouring said wet mix into said mold through the top plate centrally aligned opening, said top plate centrally aligned opening being sized to provide a space between the top plate and each of said plural through channel negatives, Step 4. After the refractory is cast into the mold, it is vibrated to remove air pockets from the material and provide a dense, uniform mass, Step 5. The entire mold with cast refractory is leveled to ensure a finished product having surfaces that are square relative to cylindrical shell walls, Step 6. The entire leveled mold with cast refractory is covered with an inner layer of wet burlap and an outer layer of plastic so as to prevent quick dehydration, to prevent formation of a skin, and to allow slow maturation of the casting, Step 7. Allow to air dry for at least 24 hours, Step 8. Remove top plate from said unitary, single piece refractory plate casting, Step 9. Remove bottom plate and plural ball seal negatives, leaving the cylindrical shell about said unitary, single piece refractory plate casting and leaving the plural through channel negatives in place within the said unitary, single piece refractory plate casting, Step 10. Prepare and treat any cosmetic surface blemishes due to air bubbles in mold during maturation found in plural ball seal vacancies using a sourizing cement, Step 11. Place casting on a rack in curing furnace to remove free and chemical water, and to burn out through channel negatives, and cure for approximately 72 hours.

15. The method of casting a unitary, single piece refractory plate of claim 14 wherein said portions of said mold which are lined with said sheet insulation material comprise the inner surface of the cylindrical shell at locations spaced from said second edge of said cylindrical shell, and a portion of said first flange which both confronts said refractory plate and which is spaced apart from said inner surface of said cylindrical shell.

16. The method of casting a unitary, single piece refractory plate of claim 14 wherein said top plate lower surface is provided with an outwardly extending bead, said bead comprising a half-round cross section, said bead spaced from the peripheral edge of said top plate such that it forms a circular channel in the top face of the casting for receiving gasketing material therein.

17. A method for forming a unitary, single-piece refractory tube sheet for supporting the terminal ends of elongate ceramic tubes within a heat exchanger operating using temperatures in the range of 1000 to 2800 degrees F., the unitary, single piece refractory tube sheet being fabricated by casting in place, as a monolithic structure, within an outer shell wall of the heat exchanger.

18. The method for forming said unitary, single-piece refractory tube sheet of claim 17 wherein a mold is used to form said casting of said unitary, single piece refractory tube sheet, wherein said mold comprises a cold-rolled steel bottom plate, a top plate, said cylindrical outer shell wall, plural machined ball seal negatives for forming ball seal sockets within said unitary, single-piece refractory tube sheet, and plural negatives for forming through channels within said unitary, single-piece refractory tube sheet, wherein the bottom plate comprises a short cylindrical casting plate and a short cylindrical alignment plate, said casting plate comprising a first height and first diameter, a casting plate upper surface, and a casting plate lower surface, said alignment plate comprising a second height and second diameter, an alignment plate upper surface, and an alignment plate lower surface, wherein said second diameter is greater than the first diameter and wherein said casting plate lower surface is secured to said alignment plate upper surface such that the casting plate and alignment plate are concentric, each of said plural machined ball seal negatives comprises an arcuate body portion, said body portion having a truncated upper surface and a truncated lower surface, each respective lower surface of said plural ball seal negatives being mounted to said casting plate upper surface, each of said plural negatives for forming through channels comprises an elongate body portion having an first end and a second end, wherein each respective second end of said plural negatives for forming through channels is secured to a respective upper surface of one of said ball seal negatives, said outer shell wall comprises a thin-walled hollow steel cylinder, the cylinder comprising an upper edge, a lower edge, and a shell wall outer diameter, wherein the lower edge of the outer shell wall is secured to said alignment plate, said top plate comprising short cylinder having a third height and third diameter, a top plate upper surface, a top plate lower surface, and a central opening, wherein said third diameter is equal to the shell outer wall diameter, such that in use, the casting plate is secured to the alignment plate, the alignment plate is secured to the lower edge of the outer shell wall, thus forming said mold wherein the casting plate provides a mold bottom surface, wherein said outer shell wall provides cylindrical mold side walls, and said plural machined ball seal negatives and said plural negatives for forming through channels are positioned within the mold using precisely located predrilled through-holes within the bottom plate, and wherein the top plate is secured to said upper edge of said outer shell wall such that the tube negatives extend upward through said central opening therein, thereby forming a mold top surface, and the top plate is secured to said upper edge of said outer shell wall.

19. The method for forming said unitary, single-piece refractory tube sheet of claim 18 wherein the following method steps are used:

Step 1. Cast the tube sheet by placement of wet casting material in mold, the casting material placed within the mold by passing it through a vacancy between the tube negatives and the top plate, Step 2. Vibrate casting to remove air pockets and to densify casting material, Step 3. Level the mold to ensure a finished product having surfaces which are square relative to shell walls, Step 4. Cover the entire leveled form with a bilayer covering, said bilayer covering comprising an inner layer of wet burlap and an outer layer of plastic, said bilayer covering used to prevent quick dehydration and formation of a "skin", and to allow slow maturation of the casting, Step 5. Air dry for at least 24 hours, Step 6. Strip casting of top plate, bottom plate, and ball seal negatives, Step 7. Place casting on a rack in curing furnace to remove free and chemical water, and to burn out through channel negatives, cure for approximately 72 hours.

20. The method of forming said single piece refractory tube sheet of claim 19 wherein insulation means are provided between portions of the outer shell wall and the casting material.

21. The method of forming said single piece refractory tube sheet of claim 19 wherein said plural machined ball seal negatives and said plural negatives for forming through channels are precisely positioned on the upper surface of the casting plate using precisely located predrilled through holes within the bottom plate.

22. The method for forming said single piece refractory tube sheet of claim 21 wherein the top plate comprises a peripheral edge, and the peripheral edge of said top plate is secured to said upper edge of said outer shell wall thereby forming a mold top surface.

23. The method for forming said single piece refractory tube sheet of claim 22 wherein the top plate is provided with a centrally positioned opening, and the body portion of each of said plural negatives for forming a through channel extends upwards through said centrally positioned opening in said top plate.

24. The method of forming said single piece refractory tube sheet of claim 23 wherein said top plate lower surface is provided with an outwardly extending bead, said bead comprising a half-round cross section, said bead spaced from the peripheral edge of said top plate such that it forms a circular channel in the top face of the casting for receiving gasketing material therein.

25. The method of forming said single piece refractory tube sheet of claim 19 wherein said casting material comprises a calcium aluminate cement bonded with mullite, bauxite, and calcined aluminas.

26. The method of forming said single piece refractory tube sheet of claim 19 wherein said plural machined ball seal negatives are formed of ultra high molecular weight polyethylene.

27. The method of forming said single piece refractory tube sheet of claim 19 wherein said plural negatives for forming through channels are formed of polyvinyl chloride.

28. A unitary refractory ceramic tube sheet in combination with a ceramic air-to-air indirect heat exchanger, the heat exchanger for use in operation conditions which include temperatures in the range of 1000 to 2800 degrees F., wherein the heat exchanger comprises an array of elongate ceramic tubes in a parallel configuration housed within an elongate vessel, the vessel comprising a vessel first end and a vessel second end, each elongate ceramic tube within said array of elongate ceramic tubes comprising a first terminal end, a second terminal end, and a body portion which extends between said first terminal end and said second terminal end, said tube sheet comprises a single-piece, monolithic refractory ceramic plate, said plate comprising an inner face, and an outer face opposed to said inner face and separated from the inner face by the thickness of the plate, said plate further comprising a longitudinal axis which lies normal to both said inner face and said outer face, said longitudinal axis lying parallel to each elongate ceramic tube, each of said inner face and said outer face comprising a peripheral edge, each of said inner face and said outer face comprising a central region which is surrounded by and spaced apart from said peripheral edge, said central region being centered on said longitudinal axis, said plate comprising a plurality of through channels sized to receive the terminal ends of said ceramic elongate tubes, said plurality of through channels being located in said central region and aligned in parallel with said longitudinal axis, each of said plurality of through channels comprise an inner end which intersects said inner face of said plate, and each of said plurality of through channels comprise an outer end which intersects said outer face of said plate, said tube sheet supporting the respective first terminal ends of said elongate ceramic tubes by receiving said first terminal ends within said respective inner ends of said through channels.

29. The unitary refractory ceramic tube sheet in combination with a ceramic air-to-air indirect heat exchanger of claim 28 wherein said plate is fabricated in the shape of a cylinder, and said cylinder has a thickness and a diameter, said plate being fabricated to have a diameter to thickness ratio of approximately 5 to 1.

30. The unitary refractory ceramic tube sheet in combination with a ceramic air-to-air indirect heat exchanger of claim 28 wherein said plate comprises an outer wall which corresponds to the thickness of the plate and extends between said inner face and said outer face, said plate further comprises a shell, said shell comprising a hoop formed in the shape of a hollow cylinder, said hoop having a thickness and a height, said hoop comprising a hoop inner face and a hoop outer face, the hoop inner face being opposed to and separated from the hoop outer face by the thickness of the hoop, where the thickness of the hoop is small relative to the height of the hoop, said hoop comprising a first hoop edge and a second hoop edge, the first hoop edge being opposed to the second hoop edge and separated from it by the respective hoop inner and outer faces, and said hoop inner face confronts and abuts at least a portion of said outer wall of said plate, said hoop comprises a first flange and a second flange, wherein said first flange lies adjacent to said first hoop edge, and wherein said second flange lies adjacent to said second hoop edge.

31. The unitary refractory ceramic tube sheet in combination with a ceramic air-to-air indirect heat exchanger of claim 30 wherein insulation means is provided between portions of said outer wall of said plate and said hoop inner face, and is provided between portions of said second flange of said hoop and inner face of said plate.

32. The unitary refractory ceramic tube sheet in combination with a ceramic air-to-air indirect heat exchanger of claim 30 wherein each of said inner ends of said plurality of through channels comprises an enlarged region which is sized and shaped so as to receive a sealing member therewithin, and each of said outer ends of said plurality of through channels comprises a tapering cross section, said tapering cross section having a minimum diameter at a location spaced from said outer face, and a maximum diameter at said intersection with said outer face.

33. A unitary ceramic tube sheet for supporting the terminal ends of plural elongate ceramic tubes within a heat exchanger operating using temperatures in the range of 1000 to 2800 degrees F., the tube sheet comprising a single, unitary plate, the plate comprising a central region and a peripheral region, said central region surrounded by and concentric with said peripheral region, the plate comprises an inner face and an outer face, said inner face being opposed to said outer face and separated from it by the thickness of said plate, the plate comprising a longitudinal axis which lies perpendicular to both said inner face and said outer face the central region comprising a plurality of through holes sized and shaped to receive the terminal ends of said plural elongate ceramic tubes therein, wherein said plurality of through holes extend through the thickness of said plate such that they lie in parallel with the longitudinal axis, each of said plurality of through holes comprising a circular cross section of a first diameter, each of said plurality of through holes comprising an enlarged region adjacent to said outer face such that the intersection of each of said plurality of through holes with said outer face comprises a generally circular cross section of a second diameter, wherein the second diameter is greater than the first diameter, said enlarged region comprising tube sheet threads formed on the surface thereof, the tube sheet further comprising an elongate hollow plug positioned within each of said plurality of through holes, said plug comprising a first end and a second end, said second end separated from said first end by a mid portion, said plug comprising an exterior and an interior, wherein said exterior of said first end is provided with plug threads formed on the surface thereof, said plug threads sized and shaped to matingly engage said tube sheet threads so as to allow securement and positional adjustment of said plug within each of said plurality of through holes, said second end of said plug comprising an articulating socket, said articulating socket received within each of said plurality of through holes such that it lies adjacent to said inner face of said plate, said articulating socket receiving and supporting the terminal end of an elongate ceramic tube therein such that the terminal end of an elongate ceramic tube is capable of rotational motions, said articulating socket comprising a spherical mating surface which lies between the mid portion and the second end, the second end terminating in a longitudinally aligned extension of the interior surface such that it extends beyond the exterior surface to form an insertion ring, said insertion ring comprising an insertion ring exterior surface which is sized to be received within the interior of said elongate ceramic tube when in use.

34. A combination unitary tube sheet and plural adjustable tube securement means, wherein said plural adjustable tube securement means are for use in securing and adjusting the terminal ends of plural elongate ceramic tubes supported by said unitary tube sheet within a heat exchanger vessel, wherein said unitary tube sheet comprises a monolithic refractory ceramic plate, the plate comprising an inner face and an outer face, said inner face being opposed to said outer face and separated from it by the thickness of said plate, a longitudinal axis which lies perpendicular to both said inner face and said outer face, a plurality of through holes sized and shaped to receive the terminal ends of said plural elongate ceramic tubes therein, said plurality of through holes extending through the thickness of said plate such that they lie in parallel with the longitudinal axis, and wherein one of said plural adjustable tube securement means resides within each of said plurality of through holes.

35. The combination unitary tube sheet and plural adjustable tube securement means of claim 34 wherein said plural adjustable tube securement means comprises a plug, said plug comprising an elongate hollow tube provided with exterior threads at a first end and a second end which is opposed to the first end, said first end of said plug is received within a vacancy formed at the intersection of each of said plurality of through holes and the outer face of said tube sheet, said vacancy comprising a generally cylindrical void in said outer face, said void comprising a threaded region, said threaded region being sized and shaped to matingly received the exterior threads of said first end of said plug therewithin.

36. The combination unitary tube sheet and plural adjustable securement means of claim 35 wherein said first end of said plug is provided with a sealing washer, said sealing washer comprising a flat hollow disk, the disk residing in said vacancy such that lies between said plug and said outer face of said tube sheet, the disk fixed within said vacancy and fixed in abutting confrontment with said plug using a glaze so that when in use fluid leakage is prevented between the plug and said respective through hole.

37. The combination unitary tube sheet and plural adjustable securement means of claim 36 wherein said second end of said plug terminates in an articulating socket, said articulating socket receiving and supporting the terminal end of an elongate ceramic tube therein such that rotational motions of the terminal end of an elongate ceramic tube are allowable.

38. The combination unitary tube sheet and plural adjustable securement means of claim 37 wherein said articulating socket comprises a spherical mating surface which lies between the first end and the second end such that it is adjacent to said second end, the second end terminating in an insertion ring, said insertion ring comprising a longitudinal extension of the interior surface of the plug, said insertion ring comprising an insertion ring exterior surface which is sized to be received within the interior of said elongate ceramic tube when in use.

* * * * *